US006679213B2

(12) United States Patent
Kurita

(10) Patent No.: US 6,679,213 B2
(45) Date of Patent: Jan. 20, 2004

(54) STARTER ARRANGEMENT AND METHOD FOR AN ENGINE

(75) Inventor: Yoshikazu Kurita, Shuuchi-gun (JP)

(73) Assignee: Kabushiki Kaisha Moric, Shuuchi-gun (JP)

( * ) Notice: Subject to any disclaimer, the term of this patent is extended or adjusted under 35 U.S.C. 154(b) by 0 days.

(21) Appl. No.: 10/063,641

(22) Filed: May 7, 2002

(65) Prior Publication Data

US 2002/0170517 A1 Nov. 21, 2002

(30) Foreign Application Priority Data

May 17, 2001 (JP) ..... 2001-147860

(51) Int. Cl.[7] ..... F02N 17/00

(52) U.S. Cl. ..... 123/179.3; 123/179.25; 290/38 R

(58) Field of Search ..... 123/179.3, 179.4, 123/179.1, 179.25; 290/38 R

(56) References Cited

U.S. PATENT DOCUMENTS

| | | | | | |
|---|---|---|---|---|---|
| 4,677,365 | A | * | 6/1987 | Yang | 322/90 |
| 5,402,758 | A | * | 4/1995 | Land et al. | 123/179.3 |
| 5,914,575 | A | * | 6/1999 | Sasaki | 318/150 |
| 5,938,114 | A | * | 8/1999 | Zeyen et al. | 237/12.3 R |
| 6,033,041 | A | * | 3/2000 | Koga et al. | 303/152 |
| 6,537,169 | B1 | * | 3/2003 | Morii | 475/8 |

* cited by examiner

*Primary Examiner*—John Kwon
(74) *Attorney, Agent, or Firm*—Ernest A. Beutler

(57) ABSTRACT

An improved DC electrical starting motor and method for starting internal combustion engines that reduces starter motor noise in the period after the engine starts by effecting breaking of the starter motor shaft at that time. Preferably the braking is accomplished by regenerative braking.

10 Claims, 5 Drawing Sheets

STARTER ARRANGEMENT AND METHOD FOR AN ENGINE

BACKGROUND OF INVENTION

This invention relates to a starter motor for an engine for a vehicle such as a motorcycle or the like and to a method for starting such engines and reducing starter noise at the time of the starting operation.

In an engine for a vehicle such as a motorcycle, a starter motor is used at the time of engine starting to rotate an engine shaft under battery power. The starter motor is generally a DC motor driven through a relay by operation of a manual switch such as main switch or a starter switch of the vehicle. In this case, the switch is first turned ON to rotate the starter motor, for cranking. When the engine is started after the starter motor load drops to zero, resulting in a maximum rotational speed. At this moment, the switch is turned OFF to stop the power supply to the starter motor. As a result, the starter motor output shaft is disconnected from the engine shaft by a one way clutch type of device and it rotates idly by its inertia and stops after gradually reducing its rotational speed.

At the time of the engine starting described above, during the time while the starter motor is stopping its rotation after the power supply to the starter motor is OFF it generates an abnormal and unpleasant noise. The cause of this phenomenon may be understood by reference to FIG. 1. In this figure the horizontal axis represents time and the vertical axis represents both starter motor rotational speed and noise level.

The power source of the starter motor is turned ON at a time t0 and begins to rotate for cranking. When the engine is started, the starter motor load drops to zero and the rotational speed increases to a maximum. At a time t1 when this state is reached, the starter switch is turned OFF by hand.

As a result, the starter motor rotates idly as a result of its inertia, decreasing its rotational speed gradually and stopping eventually at a time t2. Between the times t1 and t2, an abnormally high noise is generated. The noise at this point is an abnormal and unpleasant one and unusually is louder than the engine noise or even that of the starter motor during the actual starting operation.

This abnormal noise is caused by the starter motor yoke of its stator resonating when the natural frequency of the yoke coincides with the number of times of cogging reaction at a specific motor speed. This resonance frequency corresponds to a frequency determined by the least common multiple of the number of slots of an armature and the number of magnetic poles of magnets, or the cogging number/rotation, and the cogging reaction produced at a specific motor speed. In an actual measurement shown in FIG. 1, the cogging number is the least common multiple of 28 for a motor with fourteen slots and four-pole magnets. An abnormal noise is generated at the time of the rotational speed of 5100 rpm. In this case, the resonance frequency is expressed as follows:

$$(28\times5100/60)\times2=4760\text{ Hz.}$$

More specifically, an armature connected to the output shaft of the starter motor is formed of a plurality of radially disposed cores. Electrical coils are wound on these cores and face a plurality of magnets on the inside surface of the starter motor yoke. The armature is rotated through successive attractions of magnetic forces of the magnets.

When the cores of the armature pass across the magnets and its polarities are changed, the armature changes its rotational torque, generating cogging with a perturbed movement. Therefore, the larger the magnetic forces are, the greater cogging is generated, resulting in an abnormal noise due to the reaction.

Normally the material of the permanent magnets is a ferrite-based magnetic material. However, neodymium-based magnets made from a magnetic material containing Nd of a rare metal element or its compound known as high-energy magnets are preferred because they permit a higher output starter motor for a given size. If such neodymium-based magnets are used, since the magnetic forces are great, the problem of an abnormal noise due to the cogging reaction is amplified.

It is therefore a principle object of this invention to provide an improved starter motor arrangement and method of starting an internal combustion engine that reduces noise during the starting operation.

SUMMARY OF INVENTION

A first feature of this invention is adapted to be embodied in a starter arrangement for an internal combustion engine. The starter arrangement comprises a DC electrical motor having an output shaft in starting arrangement with a shaft of the engine for starting the engine. A battery is provided for selectively energizing terminals of the DC electrical motor for driving the engine shaft to start the engine. A braking arrangement brakes the rotation of the starter motor output shaft when the engine starts.

In a preferred embodiment of this first feature, the braking arrangement comprises a switching arrangement that connects the terminals of the DC electrical motor to the battery to charge the battery upon the deenergization of the terminals for stopping the driving of the DC electrical motor by regeneratively braking the rotation of said DC electrical motor.

Another feature of the invention is adapted to be embodied in a method for starting an engine with a DC electrical motor and reducing starter motor noise. A DC electrical motor has an output shaft in starting arrangement with a shaft of the engine for starting the engine. A battery is also provided. The method comprises the steps of selectively energizing terminals of the DC electrical motor for driving the engine shaft to start the engine upon operator demand and the rotation of the starter motor output shaft is braked when the engine starts.

In a preferred embodiment of this other feature the starter motor output shaft is braked by connecting the terminals of the DC electrical motor to the battery to charge the battery upon starting of the engine to regeneratively brake the rotation of the DC electrical motor.

DETAILED DESCRIPTION

Figure 2:
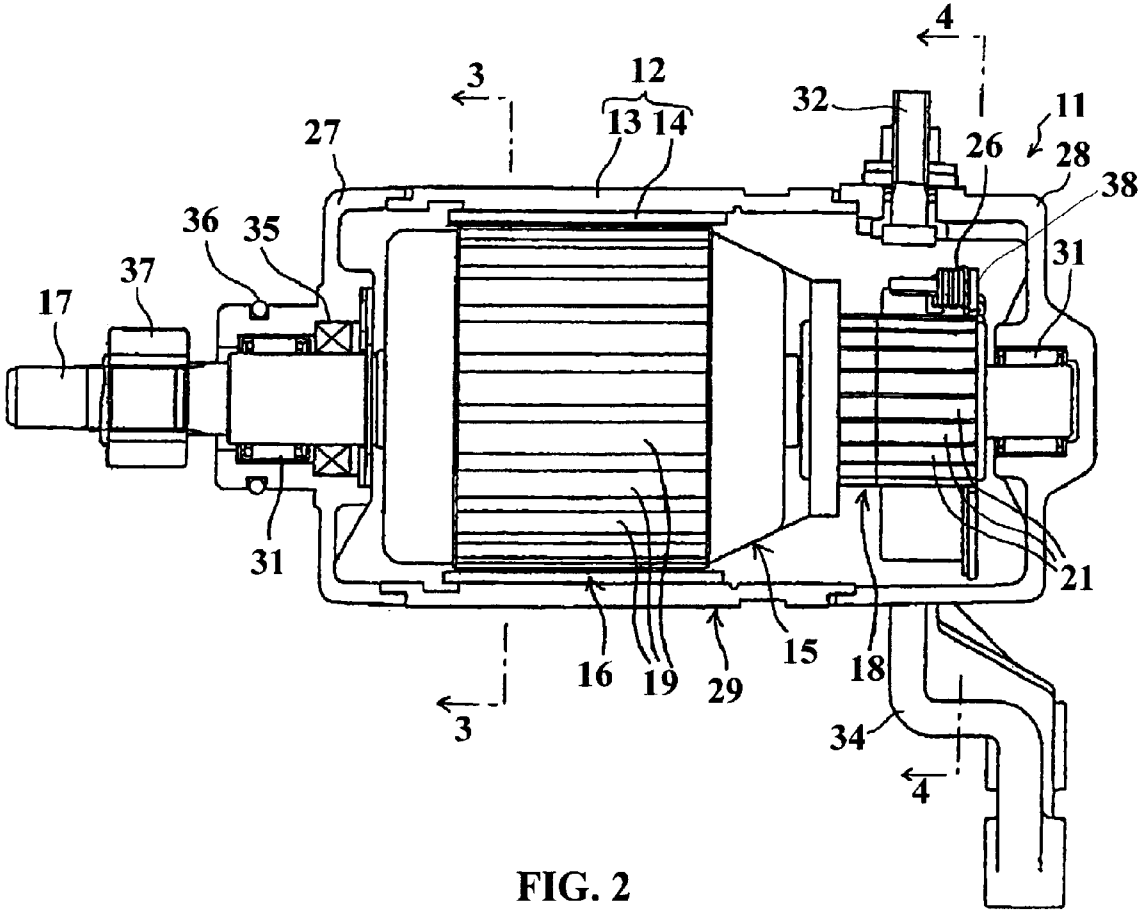
FIG. 2 is a cross sectional view of a starter motor constructed and operated in accordance with the invention.
Figure 3:
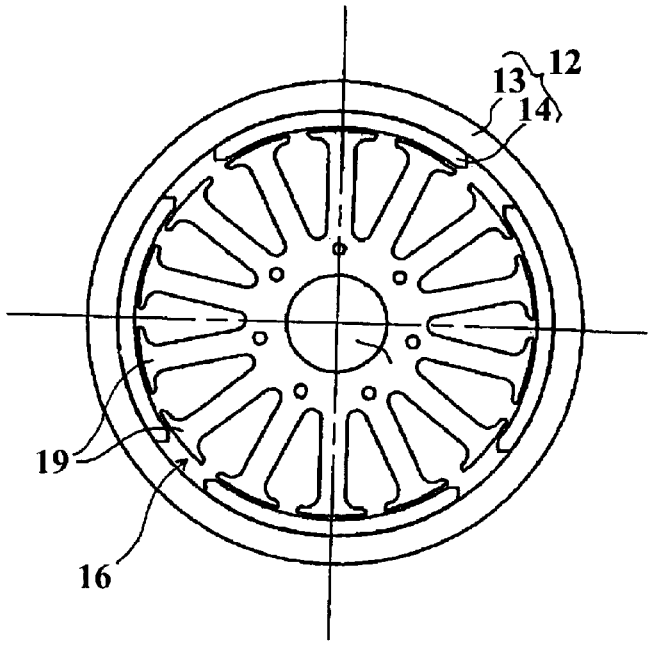
FIG. 3 is a cross sectional view taken along the line 3—3 in FIG. 2.
Figure 4:
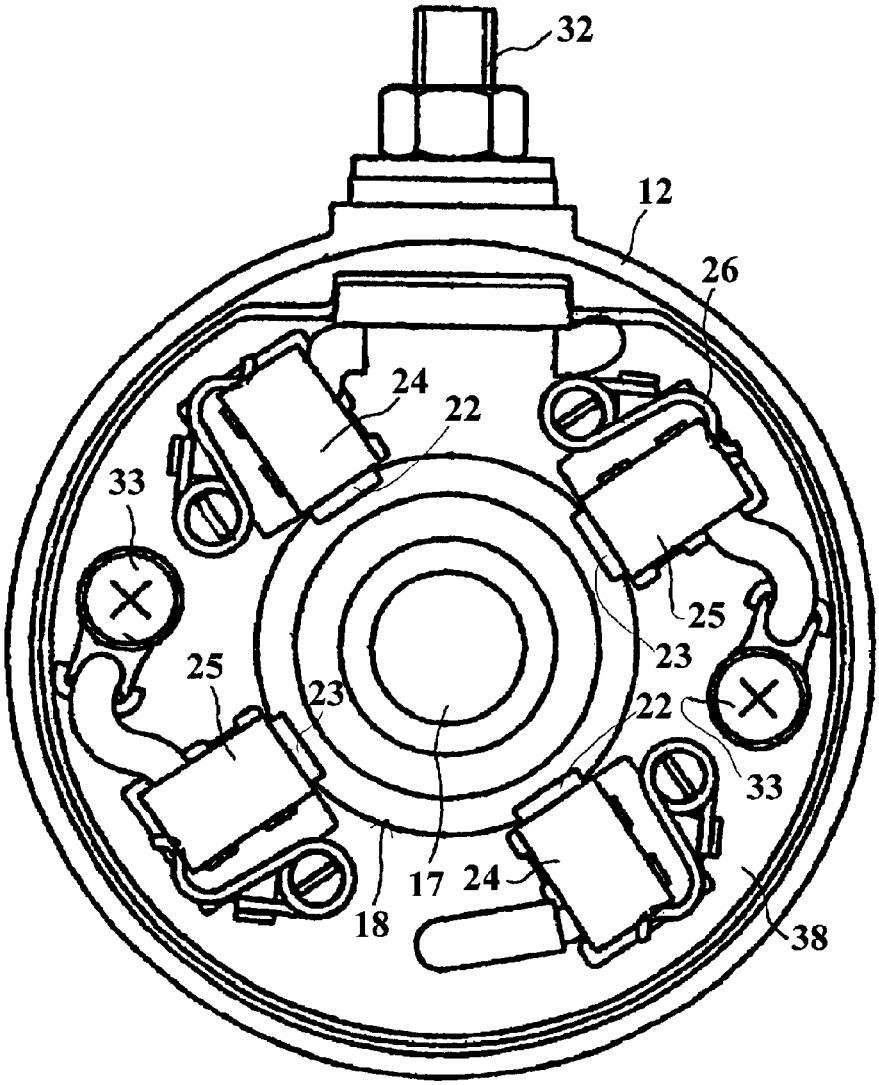
FIG. 4 is a cross sectional view taken along the line 4—4 in FIG. 2.

Referring now in detail to the drawings and initially primarily to FIGS. 2–4, a starter motor for an internal combustion engine (not shown) is indicated generally by the reference numeral 11. The starter motor 11 is comprised of a stator 12 formed of a cylindrical yoke 13 and four permanent magnets 14, of arc-shaped cross section, bonded on the inside surface of the yoke. The permanent magnets 14 are preferably formed from a neodymium (Nd)-based magnetic material that is magnetized after being bonded to the yoke 13.

An armature or rotor, indicated generally at 15 rotatably mounted inside the stator 12 in a manner to be described shortly. The armature 15 is comprised of a core 16 facing the magnets 14 and fixed to a starter motor output shaft 17. A commutator 18 is fixed adjacent to the core 16 on one end of the starter motor output shaft 17.

The core 16, as shown in FIGS. 2 and 3, is formed of a plurality of radially disposed core teeth 19. In the illustrated embodiment there are 14 core teeth 19. Electrical coils (not shown) are wound around the core pieces 19. The commutator 18 is formed of a plurality of contact pieces 21 corresponding in number to the core pieces 19 and that are electrically connected to the coil ends, as is well known in the art. Two sets of two brushes 22 and 23 (FIG. 4) held by respective brush holders 24 and 25 are juxtaposed to the commutator 18 at its outside circumference. The brushes 22 and 23 are pressed against the contact pieces 21 of the commutator 18 by coil springs 26.

Fitted to the opposite ends sides of the cylindrical yoke 13 are a front cover 27 (FIG. 2) covering the left side of the yoke 13 as seen in the figure and a rear cover 28 covering the right side of the yoke. on the figure, collectively forming, with the yoke 13, a motor case indicated generally by the reference numeral 29. The starter motor output shaft 17 is journalled for rotation on the front cover 27 and the rear cover 28, respectively by bearings 31.

On the rear cover 28 (FIGS. 2 and 4) is provided a positive terminal 32 for power supply from the positive electrode of a battery (described later by reference to FIG. 5 mounted on the vehicle. The positive terminal 32 is suitably connected to the brushes 22 on the positive electrode side. The brushes 23 on the negative electrode side (ground side) are connected to the end closure 28 by grounding fasteners 33. The motor case 29 is grounded to the associated engine by a mounting bracket 34 that fixes the starter motor 11 to the engine thus acting as a negative terminal.

On the front cover 27 is mounted an oil seal 35 (FIG. 2) for preventing ingress of oil into the motor case 29 from the associated engine, and an O-ring 36 for sealing the mounting portion to the engine. On the starter motor output shaft 17 at the engine side end is provided a pinion gear 37 meshing with an flywheel gear (not shown) to rotate the engine shaft for starting. Some form of one way device such as a one way clutch is provided in this connection to permit the engine shaft from driving the starter motor once the engine has started to run under its own power, as is well known in this art.

Inside the rear cover 28 covering the commutator 18 at the end of the starter motor output shaft 17 is fixed a disk-like brush carrier38. The brush holders 24 and 25 are affixed to the brush carrier38 at four positions spaced radially at right angles to hold the opposing two positive electrode brushes 22 and opposing two negative electrode (grounding) brushes 23. As has been noted, the brushes 22, 23 are biased radially inwardly toward the commutator 18 by the coil springs 26. The positive electrode brushes 22 are connected to the positive terminal 32, and the negative electrode brushes 23 to the negative (grounding) terminal 34.

Figure 5:
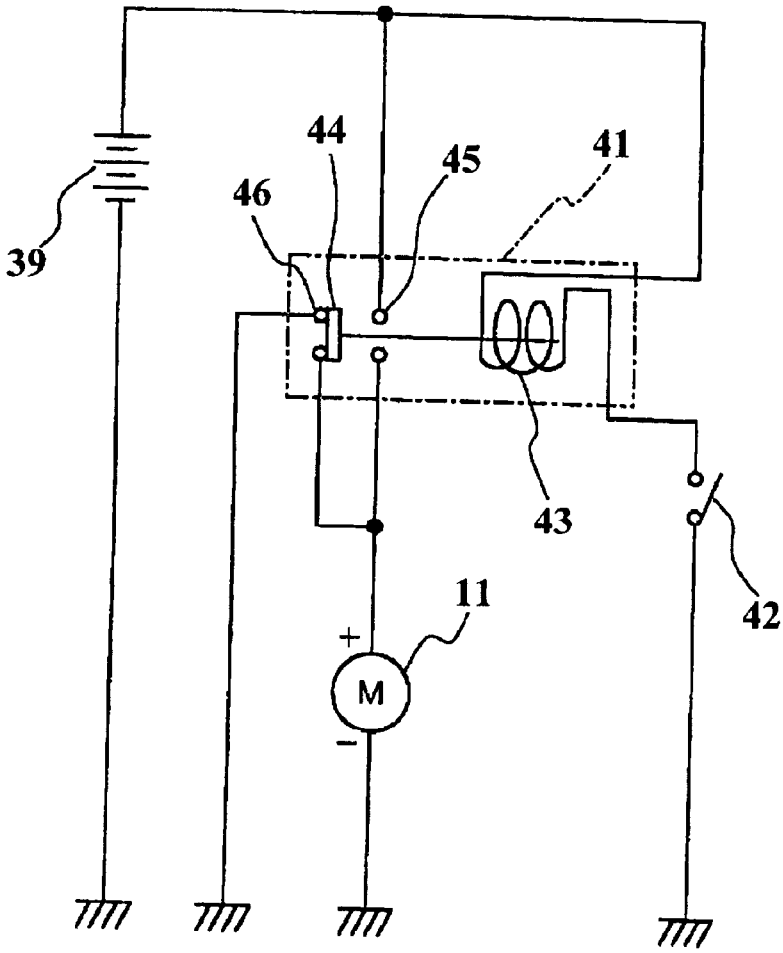
FIG. 5 is a circuit diagram of the starter motor.

FIG. 5 is a diagram of a circuit for driving the starter motor 11. The starter motor 11 is connected to the aforementioned battery 39 through a relay 41. Power supply from the battery 39 to the motor is switched ON/OFF through operation of a main or starter switch 42.

The relay 41 is comprised of a solenoid winding 43. The winding 43 encircles an armature that carries a contact plate 44. The relay 41 further comprises first and second contacts 45, 46 with which the contact plate 44 comes in contact.

When the switch 42 is closed, the magnetic force of the solenoid 43 causes the contact plate 44 to move toward the right as shown in FIG. 5, closing the first contact 45. Thus power supply from the battery 39 is ON for energization of the starter motor 11. As a result, the starter motor 11 is rotated to rotate the engine.

After the engine is started by this cranking, the switch 42 is opened. Then, the solenoid 43 is disconnected from the battery 39, and the contact plate 44 is returned to the left on the figure by a spring (not shown) and comes in contact with the second contact 46 to close it (the state shown in FIG. 5).

Figure 1:
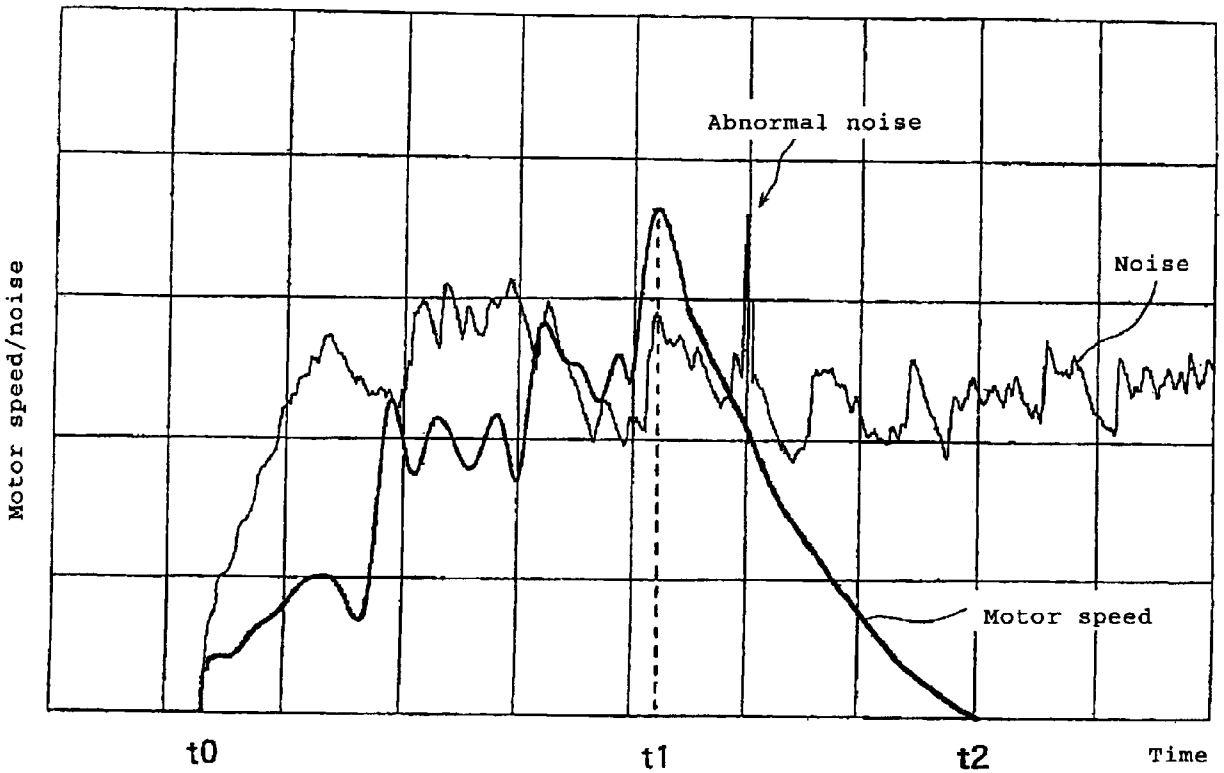
FIG. 1 is a graphical view showing the noise and speed of a prior art type of starter motor during engine starting operation.

As a result of the second contact 46 being closed, the positive and the negative electrodes of the starter motor 11 are connected. Thus, power supply from the battery 39 to the starter motor 11 is OFF, energization of the starter motor 11 is stopped, and the motor begins to rotate idly by inertia. At this moment, the positive and the negative electrode of the motor are connected, so that the starter motor 11 acts as a generator, producing regenerative electromotive force. Whereby, the function of regenerative braking is effected and the starter motor 11 is stopped quickly. The starter noise caused by the prior art as described by reference to FIG. 1 is thus substantially reduced if not totally eliminated.

Thus it should be readily apparent that the described apparatus and starting method achieves the goals set out above in a low cost and highly effective manner. Of course those skilled in the art will understand that the embodiment described is only a preferred embodiment of the invention and various changes and modifications may be made without departing from the spirit and scope of the invention, as defined by the appended claims.

What is claimed is:

1. A starter arrangement for an internal combustion engine comprising a DC electrical motor having an output shaft in starting arrangement with a shaft of the engine for starting the engine, a battery for selectively energizing terminals of said DC electrical motor for driving the engine shaft to start the engine and a braking arrangement for braking the rotation of said output shaft when the engine has started.

2. A starter arrangement for an internal combustion engine as set forth in claim 1 wherein the braking arrangement comprises a switching arrangement for connecting the terminals of the DC electrical motor to the battery to charge said battery upon the deenergization of said terminals for stopping the driving of said DC electrical motor to regeneratively brake the rotation of said DC electrical motor.

3. A starter arrangement for an internal combustion engine as set forth in claim 2 further including a manually operated switch moveable between an OFF condition and an ON condition for selectively energizing terminals of said DC electrical motor for driving the engine shaft to start the engine and the switching arrangement comprises a relay having a first contact adapted to be closed when said manual switch is ON, and a second contact adapted to be closed when said manual switch is OFF, said DC motor being connected to said battery for driving said DC motor when said first contact is closed, said DC motor is connected to charge said battery when said second contact is closed.

4. A starter arrangement for an internal combustion engine as set forth in claim 1 wherein the electrical motor starting arrangement with the engine shaft includes a one way clutching device for connecting the DC electrical motor output shaft with the engine shaft when the speed of said DC electrical motor output shaft exceeds that of the engine shaft and permitting the engine shaft to overrun said DC electrical motor output shaft when the speed of the engine shaft exceeds that of said DC electrical motor output shaft.

5. A starter arrangement for an internal combustion engine as set forth in claim 2 wherein the electrical motor starting arrangement with the engine shaft includes a one way clutching device for connecting the DC electrical motor output shaft with the engine shaft when the speed of said DC electrical motor output shaft exceeds that of the engine shaft and permitting the engine shaft to overrun said DC electrical motor output shaft when the speed of the engine shaft exceeds that of said DC electrical motor output shaft.

6. A starter arrangement for an internal combustion engine as set forth in claim 5 further including a manually operated switch moveable between an OFF condition and an ON condition for selectively energizing terminals of said DC electrical motor for driving the engine shaft to start the engine and the switching arrangement comprises a relay having a first contact adapted to be closed when said manual switch is ON, and a second contact adapted to be closed when said manual switch is OFF, said DC motor being connected to said battery for driving said DC motor when said first contact is closed, said DC motor is connected to charge said battery when said second contact is closed.

7. A starter arrangement for an internal combustion engine as set forth in claim 6 wherein the DC motor has a stator formed of a plurality of permanent magnets of arc-shaped cross section, said permanent magnets being fixed to an inside surface of cylindrical yoke and a rotor rotatable within said stator and formed by an armature connected to the starter motor output shaft.

8. A starter arrangement for an internal combustion engine as set forth in claim 7 wherein the permanent magnets are magnets are made from a neodymium (Nd)-based magnetic material.

9. A method for starting an engine with a DC electrical motor and reducing starter motor noise comprising a DC electrical motor having an output shaft in starting arrangement with a shaft of the engine for starting the engine and a battery, said method comprises the steps of selectively energizing terminals of the DC electrical motor for driving the engine shaft to start the engine upon operator demand and braking the rotation of the output shaft when the engine has started.

10. A method for starting an engine as set forth in claim 9 wherein the DC electrical motor output shaft is braked by connecting the terminals of the DC electrical motor to the battery to charge the battery upon starting of the engine to regeneratively brake the rotation of the DC electrical motor.

* * * * *